US007874451B2

(12) United States Patent
Bel

(10) Patent No.: US 7,874,451 B2
(45) Date of Patent: Jan. 25, 2011

(54) CONTAINER ASSEMBLY FOR USE ON PLANAR SURFACES OF VARYING SLOPES

(76) Inventor: Ronald Bel, 1449 Route 208, Washingtonville, NY (US) 10992

( * ) Notice: Subject to any disclaimer, the term of this patent is extended or adjusted under 35 U.S.C. 154(b) by 286 days.

(21) Appl. No.: 12/275,968

(22) Filed: Nov. 21, 2008

(65) Prior Publication Data

US 2010/0127002 A1 May 27, 2010

(51) Int. Cl.
*B65D 25/24* (2006.01)

(52) U.S. Cl. ..... 220/628; 220/629; 220/630; 220/631; 220/633

(58) Field of Classification Search ..... 220/628, 220/629, 630, 631, 633; 248/148, 237, 371, 248/393, 397; 52/126.1, 749
See application file for complete search history.

(56) References Cited

U.S. PATENT DOCUMENTS 84,595 A * 12/1868 Van Doren ..... 248/237
4,401,184 A * 8/1983 Sherry ..... 182/45
5,249,397 A * 10/1993 Monaco ..... 52/126.1
5,318,148 A * 6/1994 Franco et al. ..... 182/45
5,609,322 A * 3/1997 Bond ..... 248/558
5,913,782 A * 6/1999 Monaco et al. ..... 52/126.1
5,960,904 A * 10/1999 Ullmann ..... 182/45
6,269,905 B1 * 8/2001 Smith ..... 182/45
7,341,164 B2 * 3/2008 Barquist et al. ..... 220/629
2002/0027091 A1 3/2002 Brown
2006/0226310 A1 10/2006 Hall et al.
2008/0105489 A1 5/2008 Garrett

OTHER PUBLICATIONS

Web catalog www.lowes.com, Stanley FatMax Telescopic Metal Legs Sawhorse http://www.lowes.com/lowes/lkn?action=productDetail&productId=82586-46921-60782 Nov. 2008.

* cited by examiner

*Primary Examiner*—Anthony Stashick
*Assistant Examiner*—Kareen Rush
(74) *Attorney, Agent, or Firm*—Tracy P. Jong

(57) ABSTRACT

The present invention relates generally to containers configured for use on dual planar as well as single planar surfaces that can deviate from the horizontal. Such special receptacles can be used in a variety of static environments having sloped surfaces including: hills, damaged or structures under construction, sloping roofs, and the like. The primary object is to provide a substantially horizontal storage or support structure for objects.

20 Claims, 6 Drawing Sheets

CONTAINER ASSEMBLY FOR USE ON PLANAR SURFACES OF VARYING SLOPES

FIELD OF THE INVENTION

The present invention relates generally to utility containers, and more specifically, to containers configured for use on non-horizontal or dual planar surfaces. Such special receptacles can be used in a variety of static environments having sloped surfaces including hills, damaged or under construction structures, sloping roofs, and the like.

BACKGROUND OF THE INVENTION

There are a number of examples of storage or support devices in the prior art for use on non-horizontal surfaces (e.g., a sloped roof).

U.S. Pat. Publication No. US2008/0105489 A1 to Garrett describes a lightweight adjustable ladder and scaffold support. Bolts or pins may be passed through the holes to secure the ladder or jack to the platform. U.S. Pat. Publication No. US 2006/0226310 to Hall et al. describes a method of supporting tools and supplies atop a sloped roof. U.S. Pat. Publication No. No.: US 2002/0027091 A1 to Brown describes a knockdown roof tool box for use on inclined or pitched surfaces. U.S. Pat. No. 5,249,397 to Monaco discloses a knockdown roof platform for use on an inclined roof comprising an upper flat table top. U.S. Pat. No. 5,318,148 to Franco et al. discloses a roof brace for supporting a scaffold platform. The device includes a triangular frame with one adjustable leg. Limitations of these inventions include the ability to use the device on a single planar surface and the absence of a container-like storage capability.

U.S. Pat. No. 6,269,905 to Smith discloses a roof ridge table for use on the peak (ridge) of the roof. U.S. Pat. No. 5,960,904 to Ullmann discloses a work table for use on a peaked roof. U.S. Pat. No. 4,401,184 to Sherry discloses a roof skid for use on the peak (ridge) of the roof with edge support devices extending from the frame. Limitations of these inventions include its limited application to use on a roof ridge and no container like storage capability.

The purpose of the present invention is to overcome the shortcomings in the aforementioned prior art.

SUMMARY OF THE INVENTION

This invention is directed toward a container with adjustable support for supporting and/or storing articles intended to sit upon up to two planar surfaces that can deviate from the horizontal. From this point forward the container with adjustable support aforementioned shall have equivalent nomenclature including: the adjustable container assembly, the device, the present invention, or the invention.

Accordingly, a primary object of the present invention is to provide an adjustable container assembly for use on up to two sloping surfaces where the main container portion of the assembly is held in a substantially level position.

Another object of the present invention is to provide a light sturdy adjustable container.

It is yet another object of the present invention to provide an adjustable container capable of storing and/or supporting a variety of objects of differing scope dictated by the focus of the activity.

It is a further object of the present invention to provide height adjustment features to better accommodate user preferences.

Another object of the present invention is to provide an adjustable container where the support legs have self adjusting pivoting bases to permit adaptation to the various slope conditions of the resting surface.

It is yet another object of the present invention to provide a folding adjustable container where support legs can be adjusted to reduce storage space.

It is yet another object of the present invention to provide a folding adjustable container where support legs can be moved from the bottom portion of the adjustable container to the top where they enable secondary functions such as a carrying handle, or provide a lifting feature to assist in transporting of the adjustable container.

It is yet another object of the present invention to provide an adjustable container where the device can be used on level surfaces as well as surfaces that deviate from the horizontal.

Whereas there may be many embodiments of the present invention, each embodiment may meet one or more of the foregoing recited objects in any combination. It is not intended that each embodiment will necessarily meet each objective.

Thus, having broadly outlined the more important features of the present invention in order that the detailed description thereof may be better understood, and that the present contribution to the art may be better appreciated, there are, of course, additional features of the present invention that will be described herein and will form a part of the subject matter of the claims appended to this specification.

In this respect, before explaining at least one embodiment of the invention in detail, it is to be understood that the invention is not limited in its application to the details of construction and the arrangements of the components set forth in the following description or illustrated in the drawings. The present invention is capable of other embodiments and of being practiced and carried out in various ways. Also it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent construction insofar as they do not depart from the spirit and scope of the conception regarded as the present invention.

BRIEF DESCRIPTION OF THE DRAWINGS

The invention will be described by reference to the specification and the drawings, in which like numerals refer to like elements, and wherein.

The drawings are not to scale, in fact, some aspects have been emphasized for a better illustration and understanding of the written description.

DETAILED DESCRIPTION OF THE INVENTION

The present invention relates to a container assembly for use on planar surfaces of varying slopes. More particularly, provided are a pair of pivoting bases where each base independently self adjusts to various slopes. The attachment of the self adjusting pivoting bases to adjustable support legs, where legs adjustments pertain to length and/or angular displacement, further expand the invention's capabilities. For example, the ability to adapt to symmetrical as well as asymmetrical ridge type peaks and/or single plane sloped surfaces. Additionally, in a preferred embodiment, the support bases can be rotated upwardly and serve as a transportation handle when one desires to move or store the invention.

Because support and/or storage devices are a well known convenience type of device, the present description will be directed in particular to elements forming a part of, or cooperating with, the apparatus in accordance with the present invention. It is understood that support and/or storage device elements not specifically shown or described may take various forms well known to those skilled in the art.

As used in this application, planar surfaces that can deviate from the horizontal shall mean and may be used interchangeably with ridge type roof peaks, single planar sloping surfaces, hills, and the like. Several embodiments will be described in greater detail.

The first embodiment is depicted in FIGS. 1-6, and reveals an adjustable container assembly for use on planar surfaces of varying slopes adapted to a peaked structure that forms a ridge type peak, a common type of roofing structure. The slope of the surface shall carry its ordinary mathematical meaning defining the "steepness" of the geometry, as well as the term slope polarity, where a positive slope is defined as a rise or upward inclination from left to right, whereas a negative slope dictates a drop or downward inclination from a left to right reference.

Figure 1:
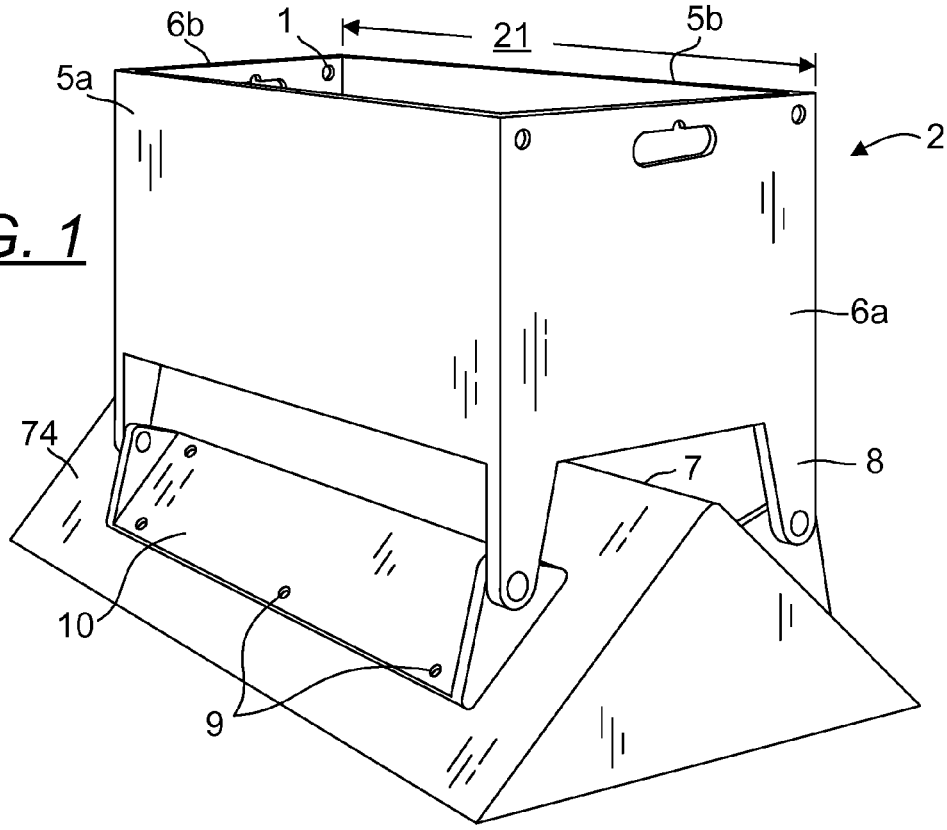
FIG. 1 is a perspective view of the container assembly resting upon a symmetrical ridge type peak.

In the aspect of the first embodiment depicted in FIG. 1, the container 2 is comprised of a bottom wall 6*c*, a front wall 5*a*, a back wall 5*b*, a first side wall 6*a*, a second side wall 6*b*, and an open top 6*d*. To better understand the embodiment depicted in FIG. 1, it is helpful to realize that there is a mirror image mechanical relationship between the front and back walls as well as between the two side walls. It is to be understood that the invention is not so limited and that although this relationship exists in the exemplary embodiment, it is not a requirement for an operational assembly according to the present invention.

The top open 6*d* can optionally incorporate an attached hinged lid or a removable lid to help secure contents. The lid can be optionally secured to container 2 by a variety of well known mechanisms designed for quick and easy access including chest latches and the like. First side wall 6*a* and second side wall 6*b* can each optionally incorporate side wall handles 3. A multitude of handle types can be used in this application, from simple cut-outs or recesses in the side wall structure, to the add-on versions such as the various styles of chest handles available. Preferably, the handle 3 incorporates a handle notch 46 to help center and secure lifting and/or hanging mechanisms such as ropes, hooks, and the like.

Figure 2:
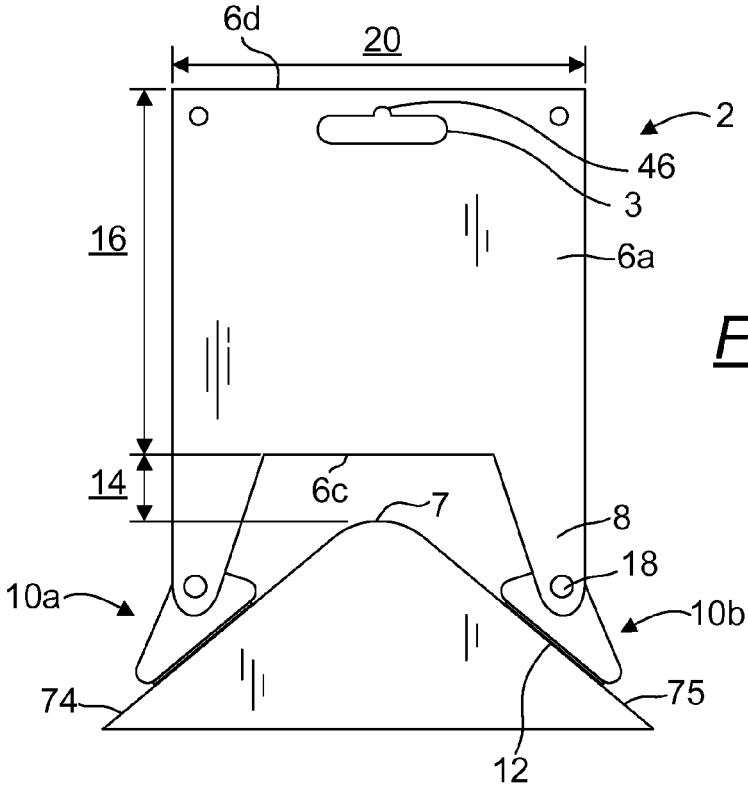
FIG. 2 is an orthogonal side view of the container assembly shown in FIG. 1.

In one embodiment of container 2 depicted in FIG. 2, container width 20 ranges from about 10 to about 14 inches, container length 21 ranges from about 16 to about 24 inches, container height 16 ranges from about 8 to about 14 inches, and the peak clearance 14 ranges from about ¾ to about 3 inches. For stability purposes, a lower peak clearance 14 dimension is preferred. It is preferable that the underside of container 2 not be in physical contact with ridge caps and/or ridge vents commonly found atop of roof ridge structures. As will be apparent to those skilled in the art, the adjustable container's dimensions are adjusted proportionately such that complete secure seating occurs by straddling the ridge caps and/or ridge vents, thereby minimizing the risk of damage and/or unstable seating. It is understood that stated dimensions, ranges, and relationships are but illustrative examples, and that the present invention can depart from the confines of the examples without deviating from the spirit of the inventive concept.

First side wall 6*a* and second side wall 6*b* each optionally incorporate side wall utility holes 1. The utility holes 1 provide secure attachment points to tether a rope or similar material to help move or secure the adjustable container when in use, during transport or during storage. It is to be understood that alternatives such as the use of slots, eye-screws, and the like are functional equivalents to the utility holes and considered within the scope of the present invention.

Container 2 possesses lower support regions at essentially the four external corner regions of the bottom wall 6*c* where four fixed support legs 8 are attached. In some aspects, more than four fixed support legs are incorporated and disposed in a manner so as to provide optimal stability of the container during use. The support for the four fixed support legs 8 can be derived from the bottom wall 6*c*, the front or back walls 5*a* and 5*b*, the first side wall 6*a*, the second side wall 6*b* or any combination thereof. All of the fixed support legs 8 on the bottom portion possess a pivot joint 18 (see pivot joint 18 in FIG. 2 for an example depiction). These pivot joints 18 mechanically link container 2 to a corresponding left base assembly 10*a* and right base assembly 10*b* as depicted in FIGS. 1-6. The left fixed support leg pair is linked to left base assembly 10*a*, and in mirror image likeness, the right fixed support leg pair is linked to right base assembly 10*b* as partially visible in FIGS. 1 and 3.

Figure 5:
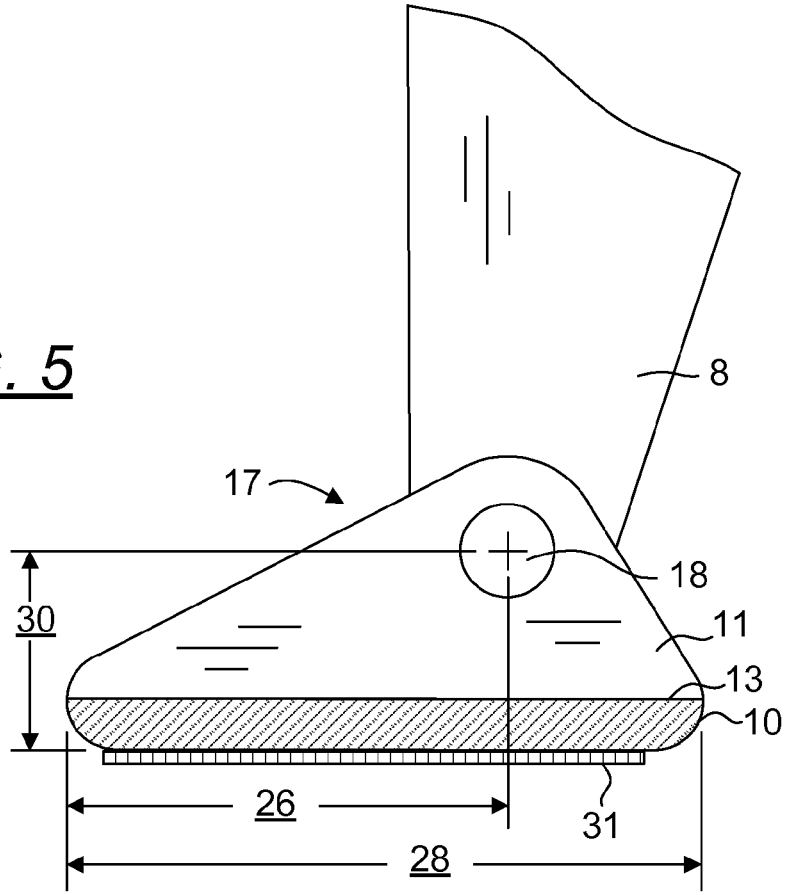
FIG. 5 is a sectional orthogonal side view of a fixed leg support with pivoting element.

A left base assembly 10*a* and a right base assembly 10*b* each have a top, a bottom, a front and a back end as depicted in FIG. 2. Each end possesses a pivoting element 17 best visible in FIG. 5 and is supported on the top by pivot joint 18 which is pivotally attached to fixed support legs 8. The bottom end of pivoting element 17 is connected to a base 10. Pivoting element 17 as depicted in FIG. 5 has a base to pivot joint dimension 30, a base width dimension 28, and a toe to pivot joint dimension 26. The toe to pivot joint dimension 26 is preferably about ⅔ of the base width dimension 28, and the base to pivot joint dimension 30 is preferably about ⅓ of the base width dimension 28. In one embodiment, the base width dimension 28 ranges from about 2 to about 6 inches. The ratios and values aforementioned are but one working example, it is understood that embodiments can deviate from the exemplary embodiment without deviating from the spirit of the invention.

Figure 6:
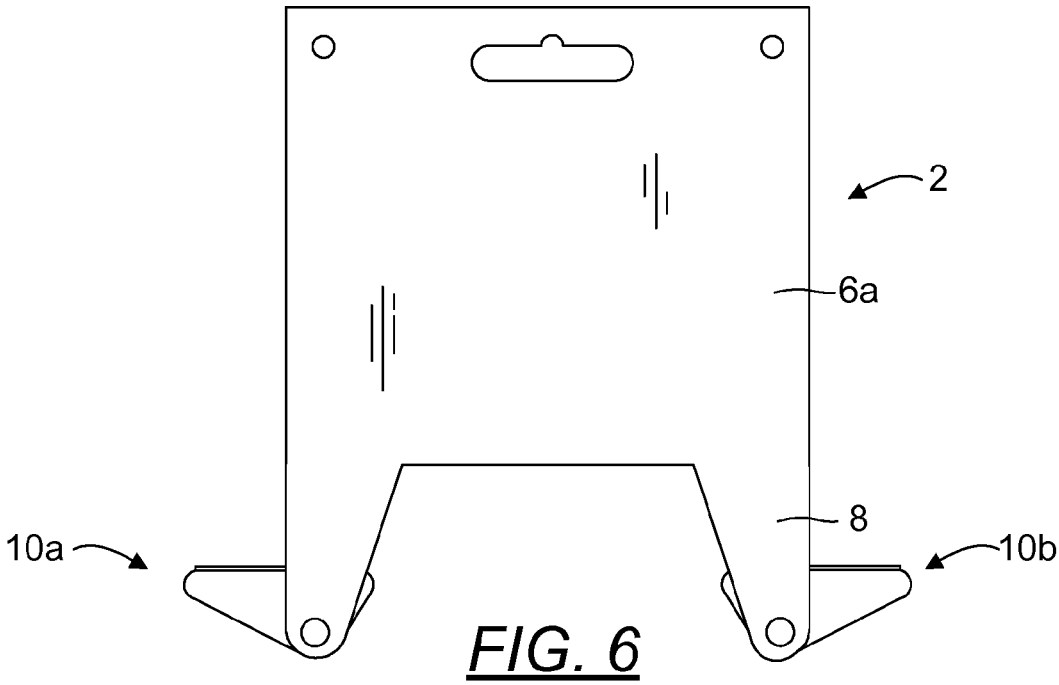
FIG. 6 is an orthogonal side view of the container assembly shown in FIG. 1 showing fixed leg supports with pivoting elements in a folded space saving state.

The left base assembly 10*a* and a right base assembly 10*b* are free to pivot in the vertical upward and downward directions. This freedom of movement enables the left base assembly 10*a* and right base assembly 10*b* to independently adapt to the slope conditions of left planar surface 4 and right planar surface 5. The adjustable container self-adjusts when set onto symmetrical or asymmetrical ridge type peaks as depicted in FIGS. 1-4. When the adjustable container is not in use, for example, during periods of transport in a vehicle or in storage, the left base assembly 10*a* and a right base assembly 10*b* can be optionally folded in an upward position to reduce the footprint and/or reduce the required floor space as depicted in FIG. 6.

Figure 3:
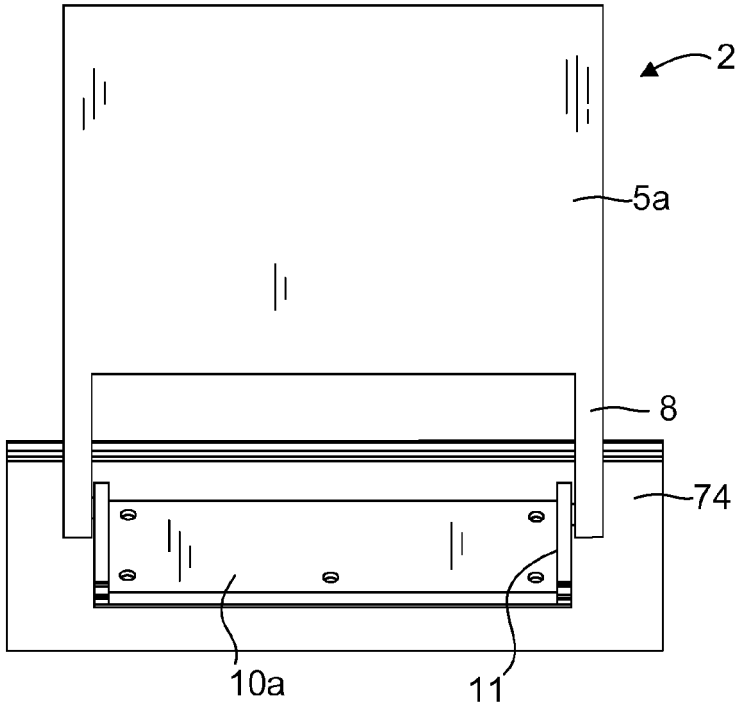
FIG. 3 is an orthogonal front view of the container assembly shown in FIG. 1.
Figure 4:
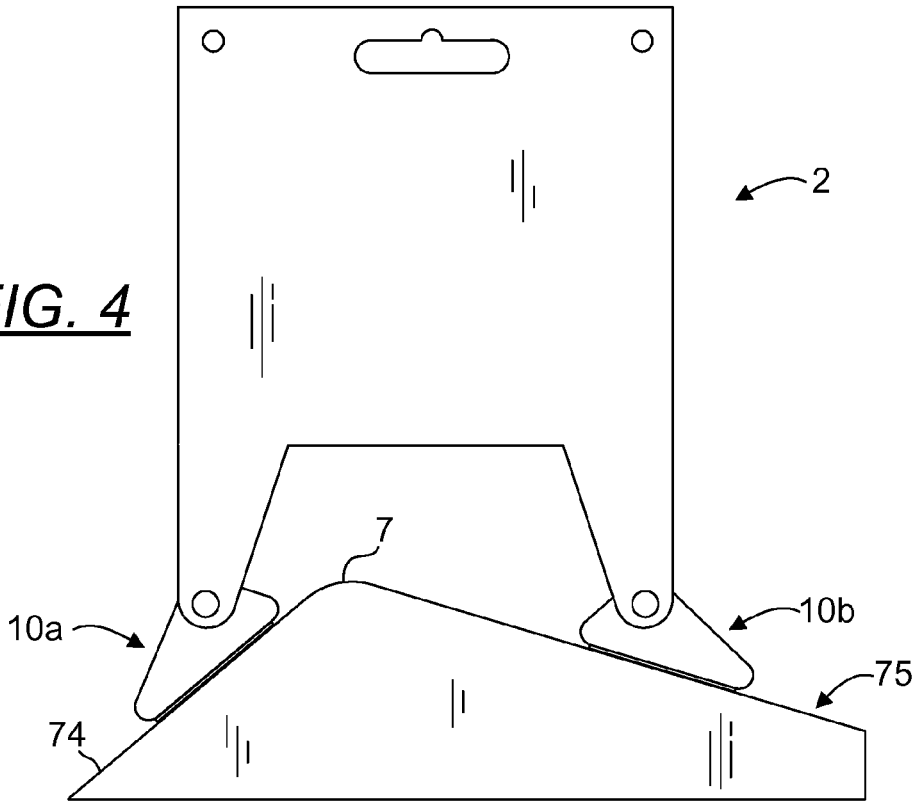
FIG. 4 is an orthogonal side view of the container assembly shown in FIG. 1 resting on a ridge type peak having two slopes of substantially different grade.

Each left base assembly 10*a* and right base assembly 10*b* has an attached base 10 element as depicted in FIGS. 1, 3, and 5. The base 10 element as depicted in FIG. 5 can optionally have a non-skid material 31 integrated into or attached to all or a portion of the bottom surface. Such a non-skid material is selected from the various families of pliable polymeric materials such as elastomers, rubbers, and the like. Alternatively, harder, less effective types of materials can also be used such as hard plastics, metals, wood, and the like. Depending on the resting surface properties, some non-skid materials can benefit from embedded groove type patterns (not shown) to enhance the seating and/or friction properties of the non-skid material.

Optionally, base 10 possesses one or more through holes 9 as depicted in FIGS. 1 and 5, residing in either one or both left base assembly 10*a* and right base assembly 10*b* in any quantity and in any location. Such through holes 9 help secure the adjustable container to the resting surface (e.g., left planar surface 4 and/or right planar surface 5 shown in FIGS. 1 and 2) by the use of a mechanical fastener such as a screw, nail, or the like. Securing the adjustable container to the resting surface may be advisable under certain conditions, for example, high winds or high traffic situations.

Figure 7:
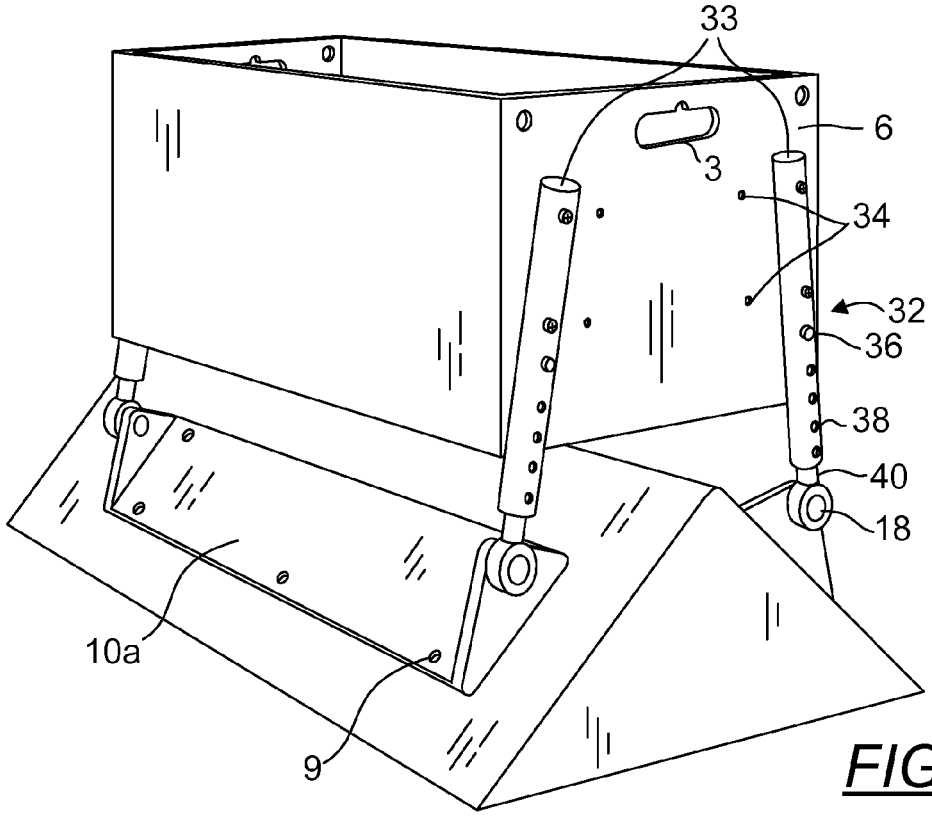
FIG. 7 is a perspective view of a second embodiment of the container assembly resting upon a symmetrical ridge type peak with locking telescopic leg supports and adjustable side wall mounting holes.

In the aspect of the second embodiment depicted in FIG. 7, the primary departure from the first embodiment of the adjustable container aforementioned is the substitution of the fixed leg supports 8 (FIG. 1) with telescopic support legs 33 (FIG. 2). More particularly, the attachment of the left base assembly 10*a* and the right base assembly 10*b* to the bottom portion of the corresponding pair of adjustable support legs. The adjustable support legs 33 substitutions permit length and/or angular displacement modifications that enable the adjustable container to adapt to a wider range of slopes possessed by peaked structures that form a ridge type peak, a common type of roofing structure. The pair of adjustable support legs 33 corresponding to left base assembly 10*a* and right base assembly 10*b* should be set to substantially the same angular displacement and length with respect to a reference (e.g. the bottom edge of side wall 6*a*, or second side wall 6*b*, or the like). The angular displacement between the left base assembly 10*a* and the right base assembly 10*b* can be set independently from each other, and dictated by user preference as well as the parameters of the planar surfaces or peaked structure (i.e. differing slopes, ridge caps or vents, and the like). This angular displacement setting of the left base assembly 10*a* and the right base assembly 10*b* is accomplished by utilizing the holes located at the upper portion of the outer support legs 32 in cooperation with support leg mounting holes 34 with the assistance of a plurality of removably attachable fasteners (e.g. nut & bolt, locking pin hardware, and the like).

The adjustable support legs 33 are comprised of inner support legs 40 slidably received within the lower end of the hollow outer support legs 32. The inner support legs 40 include a protuberance (e.g., a spring loaded pin) at their upper end that provides an interference locking structure that works in cooperation with the plurality of adjustment holes 38 at the bottom portion of the hollow outer support legs 32 to obtain the desired lengths of the left base assembly 10*a* and the right base assembly 10*b*. An alternative locking structure, which is well known in the telescopic arts, is to provide a rotational locking collar assembly (not shown) affixed to the location where the inner support legs 40 exits the hollow outer support legs 32. An example of such a component is taught by (U.S. D538,133 S) by Richardson et. al. Another option is the simultaneous use of both locking structures (not shown). Yet another useful option is to assign and label each of the plurality of adjustment holes 38 (not shown) with unique markings (e.g. 1,2,3,. . . , A,B,C, . . . , or the like) so that the setup parameters can be noted to help facilitate the future reconstruction of the setup as well as assembling additional units. The marking pattern is repeated on all four of the hollow outer support legs 32 depicted in FIG. 7.

In the aspect of the third embodiment depicted in FIGS. 8-12, the primary departure from the second embodiment of the adjustable container depicted and described with reference to FIG. 7, is the substitution of the support leg mounting holes 34 (FIG. 7) with four adjustable rotary hinges 42 (FIG. 8) for mounting onto container 2. More particularly, they differ with respect to the attachment of rotary hinges 42 to the upper portion of the outer support legs 32*a*. This eliminates the need for support leg mounting holes 34, corresponding holes located on the upper portion of the hollow outer support legs 32 shown in FIG. 7, and fastening hardware. The rotary adjustable support legs 33*a* are comprised of inner support legs 40 slidably received within the lower portion of the hollow outer support legs 32*a*. The attachment of the pivoting self adjusting left base assembly 64 and the pivoting self adjusting right base assembly 66 to the corresponding pair of rotary adjustable support legs 33*a* is identical to the aforementioned second embodiment of FIG. 7. The addition of the rotary hinges 42 to the rotary adjustable support legs 33*a* permit length and/or angular displacement modifications that enable the adjustable container to adapt to a wider range of slopes possessed by not only peaked structures (formed by the intersection of two planes) forming a ridge type peak, but sloped single planar surfaces 68 as well, both common types of roofing structures depicted in FIGS. 11 and 12.

Figure 8:
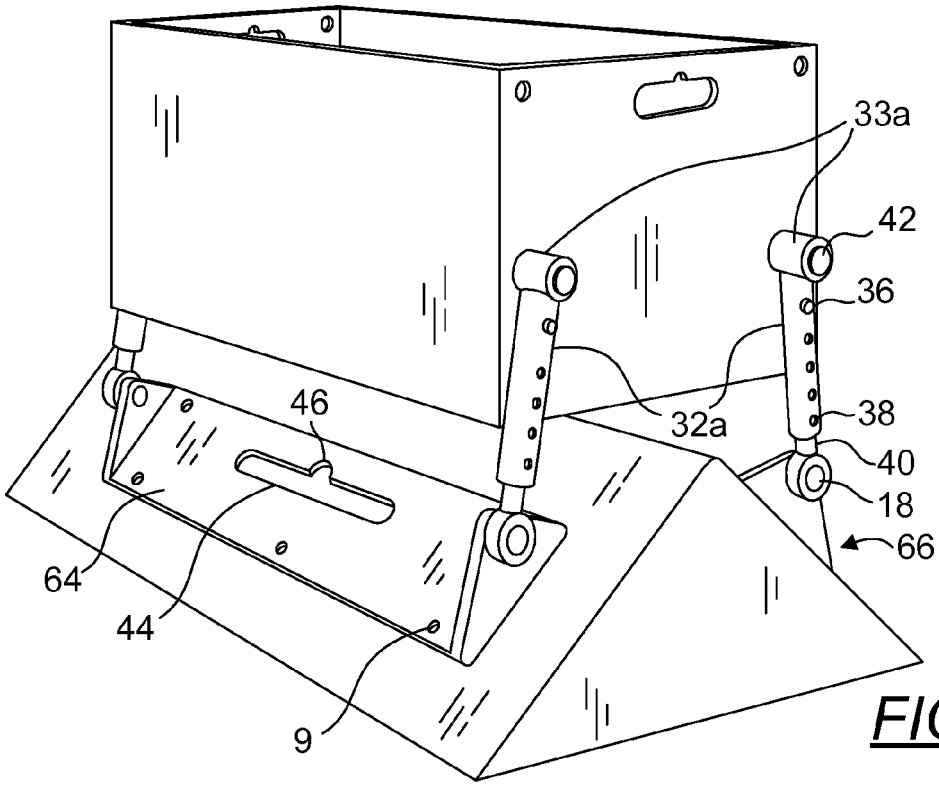
FIG. 8 is a perspective view of a third embodiment of the container assembly resting upon a symmetrical ridge type peak with locking telescopic leg supports attached to adjustable rotary hinges.
Figure 11:
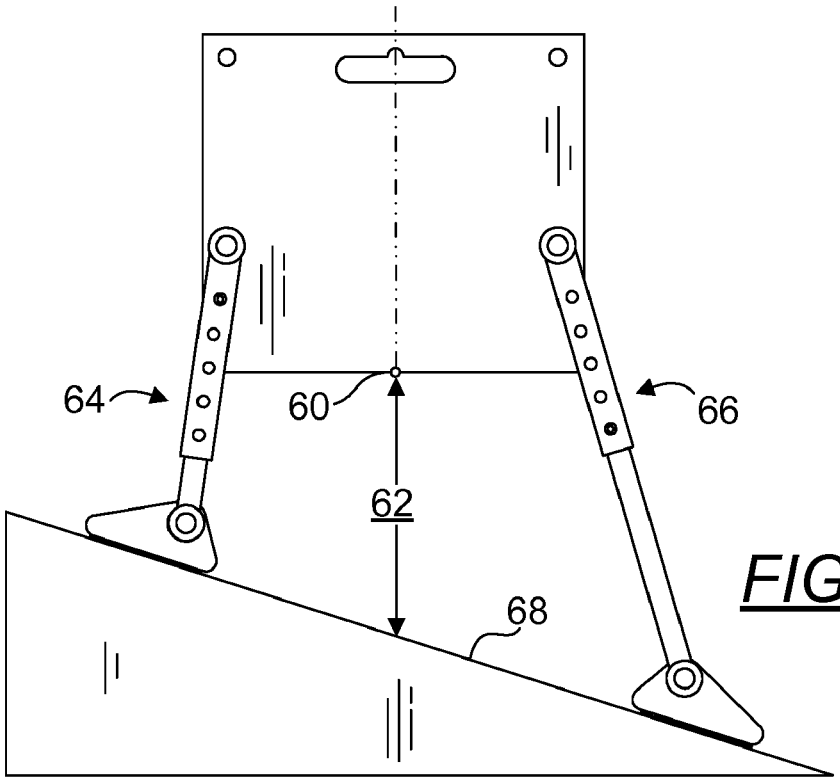
FIG. 11 is an orthogonal side view of the embodiment depicted in FIG. 8, showing the container assembly adapted to a single sloped surface.
Figure 12:
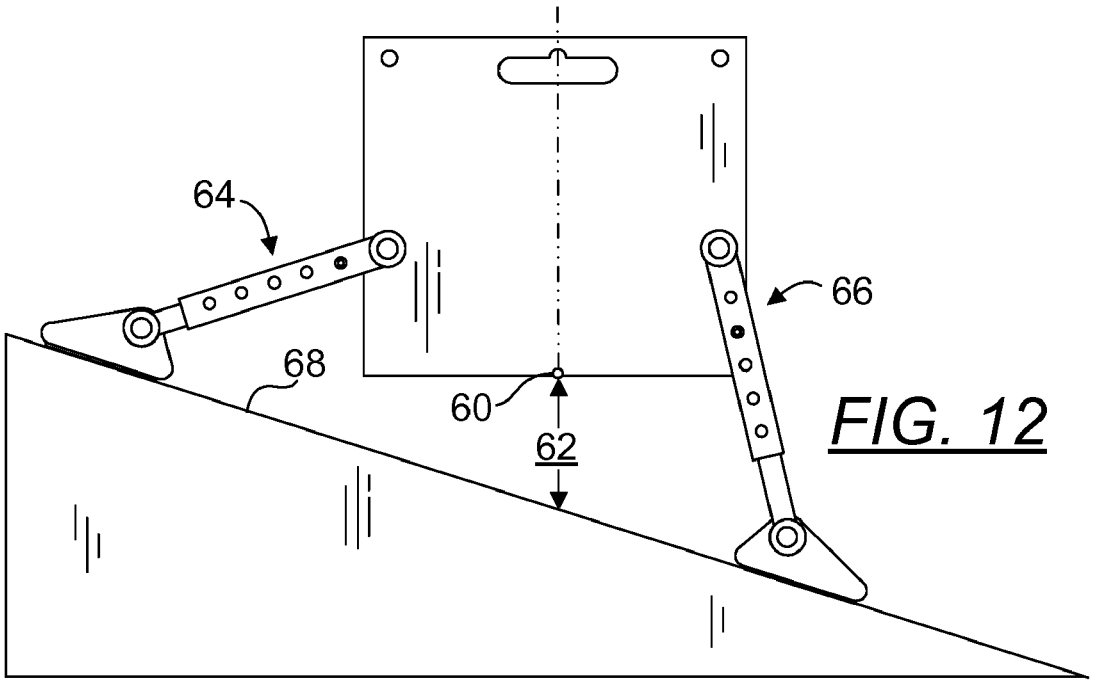
FIG. 12 is an orthogonal side view of the embodiment depicted in FIG. 8, showing the container assembly adapted to a single sloped surface having a low resting profile.

The properties attributed to the four adjustable rotary hinges 42 (FIG. 8) include, a convenient lock/unlock feature that enables the adjustment and immobilization of the desired angular displacement, and given the additional length adjustment provided by rotary adjustable support legs 33*a*, a user is presented with a myriad of mounting configurations. Example configurations (noncomprehensive) are depicted in FIGS. 8, 11, and 12. FIG. 11 depicts a configuration where the container midpoint 60 is positioned at an average distance between container 2 and planar surface 68 that is significantly greater than that depicted in FIG.12, and may be better suited for a standing user that wishes to minimize bending action. In contrast, FIG. 12 depicts an average distance between container 2 and planar surface 68 that is significantly less that that depicted in FIG. 11, and may be better suited for a user that is lying or sitting to promote easy access to the contents of container 2.

The convenient lock/unlock feature can be implemented in various configurations; static push/pull, slide activated, momentary push-button release, cable controlled, wing-nut/bolt assembly, and the like. A generous supply of adjustable rotary hinges 42 type mechanisms that are suitable for use in the present invention are available from: Adjustable Locking Technologies LLC. located at 27350 Southfield Rd. Lathrup Village, Mich. 48076. Examples of satisfactory products include: VSS10360PB, VSS10360CR, and QT15B. It should be noted that incremental locking positions with such products can range from essentially infinite resolution, to blocks of several degrees, and range of motions up to 360 degrees.

Figure 9:
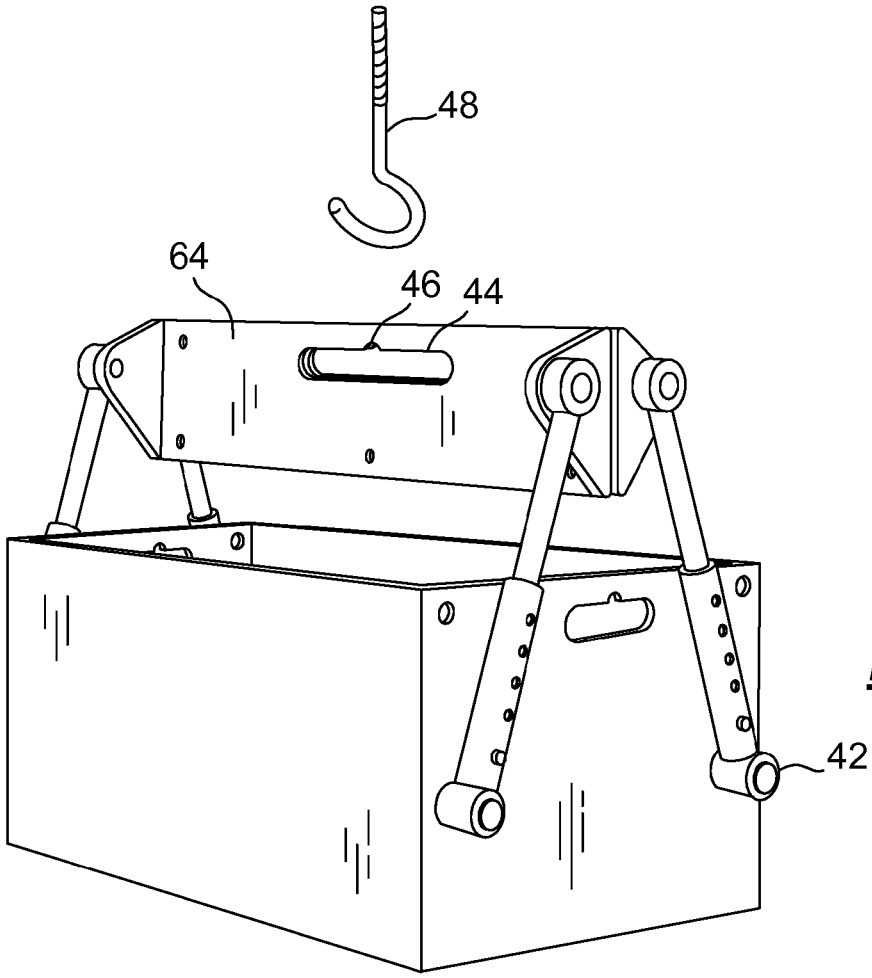
FIG. 9 is a perspective view of the embodiment depicted in FIG. 8 with telescopic leg supports and bottom bases folded into a transportation handle.
Figure 10:
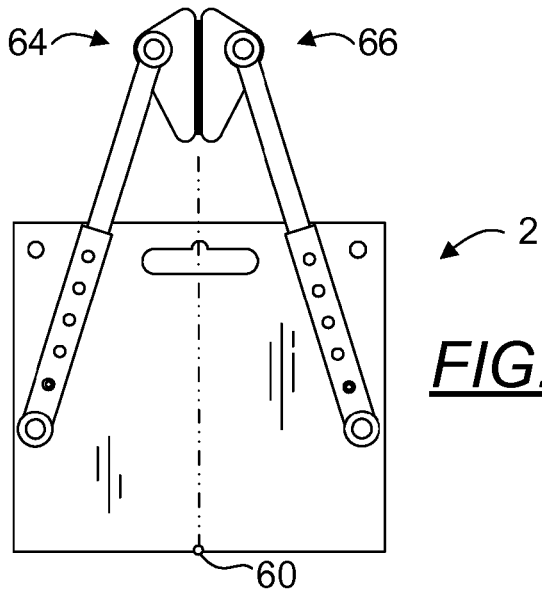
FIG. 10 is an orthogonal side view of the embodiment depicted in FIG. 9 showing symmetry of elements.

Additionally, the use of rotary hinges 42 enables a multi-functional use from the pivoting self adjusting left base assembly 64 and the pivoting self adjusting right base assembly 66 where they can function as transportation handles as depicted in FIGS. 9 and 10. To enable the transportation handle configuration, the left and right base assemblies 64 & 66 are both positioned and locked such that they are in a close proximity paired configuration with respect to each other with vertical alignment occurring above the container midpoint 60, for balance, as depicted in FIG. 10. Base handles 44*a* and 44*b* can both optionally include handle notches 46*a* and 46*b*, located at approximately above the center of gravity of the device to help center and secure lifting mechanisms such as hooks 48, ropes (not shown, and the like. Additionally, the device in this state can be manually carried by the user, and is in a space saving configuration ready for vehicle transport, storage, and the like. Furthermore, the device in this state approximates a typical toolbox for use in level environments.

In addition to the optional marking pattern associated with adjustment holes 38 repeated on all four of the hollow outer support legs 32 of FIG. 2, this embodiment benefits from an arciform marking pattern associated with the angular displacement of the left base assembly 64 as well as the right base assembly 66. Markings (not shown) indicating the angular position of the rotary adjustable support legs 33*a* can be placed, for example, on the plurality of adjustable rotary hinges 42, the pair of side walls represented by side wall 6 of container 2, or the like. Such markings assist in noting the working setup parameters which can help facilitate the future reconstruction of the setup as well as assembling additional units.

The materials that comprise the bulk of the present invention are preferably those of relatively high strength and low weight. Aluminum is one such candidate from the metals family. Alternatively, moldable plastics such as Lexan, Nylon, and the like, can provide relatively high strength and low weight properties in addition to lending itself to high production, low cost requirements. Composites such as fiberglass are other options that can provide a desired aesthetic look and/or feel in addition to supplying preferred or target combination of engineering properties such as thermal expansion, weight, creep, UV resistance, etc. for specific users and/or environments.

What is claimed herein is:

1. An adjustable container assembly for use on planar surfaces of varying slopes adapted to a peaked structure comprising of a left planar surface, and a right planar surface of essentially independent gradients of opposite slope polarity thereby forming a ridge where adjoined, said adjustable container assembly comprising:

a container having a bottom wall consisting of four external corners, four lower support regions, each lower support region is disposed at essentially one of said four external corners of said bottom wall, a front and a back wall, a first and a second side wall, and having an open top end, and one of a plurality of fixed support legs, each possessing a pivot joint member, attached to each of said plurality of fixed support legs thereby defining a left fixed support leg pair and a right fixed support leg pair, wherein each said left and right fixed support leg pair is characterized by two said fixed support legs whose alignment is parallel with said front and said back walls, and a left base assembly and a right base assembly each having a top, a bottom, a front and a back end, each said left and right base assembly possessing a pivoting element attached onto both said front and back ends thereon, and designed to cooperate with said pivot joint member of said fixed support leg, wherein said left fixed support leg pair and said right fixed support leg pair are pivotally connected to corresponding said left base assembly and said right base assembly respectively.

2. The adjustable container assembly as recited in claim 1, wherein each said right and left base assemblies includes at least one through hole creating a passage from said top to said bottom.

3. The adjustable container assembly as recited in claim 1, wherein each said bottom of said right and left base assemblies includes a friction enhancer for increasing the coefficient of friction between said bottom of said base and said peaked structure.

4. The adjustable container assembly as recited in claim 1, wherein said first and second side walls each have an upper portion including a side wall handle comprising a handle centering notch.

5. The adjustable container assembly as recited in claim 1, wherein said first and second side walls each have an upper portion including at least one utility hole.

6. The adjustable container assembly as recited in claim 1, further comprising a removably attachable lid adapted to cooperate with said open top end.

7. An adjustable container assembly for use on planar surfaces of varying slopes, said adjustable container assembly comprising:

a rectangular container having a bottom wall, a front and a back wall, a first and a second side wall, and having an open top end, said first and second sides each having a left vertical edge area and a right vertical edge area each possessing a plurality of support leg mounting holes thereon, and a plurality of support legs having a top and a bottom end, wherein said bottom end has a pivot joint member and said top end has a plurality of mounting holes, said support legs are removably attached to a set of said plurality of support leg holes located on said left vertical edge area and right vertical edge area of each said first and second side wall thereby defining a left support leg pair and a right support leg pair wherein each said support leg pair is characterized by two said support legs whose alignment is parallel with said front and said back walls respectively, and a left base assembly and a right base assembly each having a top and a bottom as well as a front and a back end, each said base possessing a pivoting element attached onto both said front and back ends thereon, and designed to cooperate with said pivot joint member of said support leg, wherein said left support leg pair and said right support leg pair are pivotally connected to corresponding said left base assembly and said right base assembly respectively.

8. The adjustable container assembly as recited in claim 7, wherein said support legs are locking telescopic supports.

9. The adjustable container assembly as recited in claim 7, wherein each of said right and left bases includes at least one through hole creating a passage from said top to said bottom.

10. The adjustable container assembly as recited in claim 7, wherein each said bottom of said right and left bases includes a friction enhancer for increasing the coefficient of friction between said bottom of said base and a resting surface.

11. The adjustable container assembly as recited in claim 7, wherein said first and second side walls, each have an upper portion, including a side wall handle having a handle centering notch.

12. The adjustable container assembly as recited in claim 7, wherein said first and second side walls, each have an upper portion, including at least one utility hole.

13. The adjustable container assembly as recited in claim 7, further comprising a removably attachable lid adapted to cooperate with said open top end.

14. An adjustable container assembly for use on planar surfaces of varying slopes, said adjustable container assembly comprising:

a rectangular container having a bottom wall, a front and a back wall, a first and a second side wall, and having an open top end, said first and second sides each having a left vertical edge area and a right vertical edge area, each said edge area possessing a rotatably locking hinge consisting of a stationary base connected thereon, said stationary base coupled to a rotating arm and a locking feature whereby relative rotational movement between said stationary base and said rotating arm is controlled, a plurality of support legs, having a top and a bottom end, said bottom end having a pivot joint member and said top end having a connection adapted to said rotating arm of said rotatably locking hinge, a left adjustable support leg pair and a right adjustable support leg pair, wherein each said left and right adjustable support leg pair is characterized by the two said support legs whose alignment is parallel with said front and said back walls respectively, and a left base assembly and a right base assembly each having a top and a bottom as well as a front and a back end, each said base possessing a pivoting element attached onto both said front and back ends thereon, and designed to cooperate with said pivot joint member of each said support leg, wherein said adjustable left support leg pair and said right adjustable support leg pair are pivotally connected to corresponding said left base assembly and said right base assembly respectively.

15. The adjustable container assembly as recited in claim 14, wherein said support legs are locking telescopic supports.

16. The adjustable container assembly as recited in claim 14, wherein each said right and left bases includes at least one through hole creating a passage from said top to said bottom.

17. The adjustable container assembly as recited in claim 14, wherein each said bottom of said right and left bases includes a friction enhancer for increasing the coefficient of friction between said bottom of said base and a resting surface.

18. The adjustable container assembly as recited in claim 14, wherein said first and second side walls each have an upper portion, including a side wall handle.

19. The adjustable container assembly as recited in claim 14, wherein said locking feature of said rotatably locking hinge is controlled by a remote cable.

20. The adjustable container assembly as recited in claim 14, further comprising a lid adapted to cooperate with said open top end.

* * * * *